United States Patent [19]

Stepe

[11] 4,007,550

[45] Feb. 15, 1977

[54] REPLACEABLE CORNER TOOTH ASSEMBLY

[75] Inventor: Visvaldis A. Stepe, Willow Springs, Ill.

[73] Assignee: Caterpillar Tractor Co., Peoria, Ill.

[22] Filed: May 19, 1975

[21] Appl. No.: 578,579

[52] U.S. Cl. ..... 37/141 T; 37/142 R; 172/777

[51] Int. Cl.[2] ..... E02F 9/28

[58] Field of Search ..... 37/141–142, 37/118, 117.5, 141 R, 141 T, 142 R, 142 A; 214/145; 172/719, 767, 777

[56] References Cited

UNITED STATES PATENTS

| | | | |
|---|---|---|---|
| 1,363,189 | 12/1920 | Mulroney | 37/142 R |
| 2,164,988 | 7/1939 | De Biasi | 37/141 T |
| 2,584,416 | 2/1952 | Boehringer | 214/145 |
| 2,914,868 | 12/1959 | Launder | 172/777 |
| 3,038,267 | 6/1962 | Helton et al. | 172/777 |
| 3,307,277 | 3/1967 | Kondracki | 37/141 R |
| 3,621,594 | 11/1971 | Hahn et al. | 37/141 T |
| 3,638,736 | 2/1972 | Hahn | 172/719 |
| 3,648,391 | 3/1972 | Kabay et al. | 37/141 T |
| 3,664,044 | 5/1972 | Hahn | 37/142 R |
| 3,748,762 | 7/1973 | Tarrant | 37/141 T |
| 3,762,079 | 10/1973 | Lukavich et al. | 37/141 R |
| 3,812,608 | 5/1974 | Ratkowski | 37/141 T |
| 3,851,413 | 12/1974 | Lukavich | 37/142 R X |
| 3,897,642 | 5/1975 | Helton et al. | 172/713 |

FOREIGN PATENTS OR APPLICATIONS

| | | | |
|---|---|---|---|
| 791,578 | 8/1968 | Canada | 37/141 R |
| 1,365,139 | 5/1964 | France | 37/118 |
| 1,210,129 | 10/1970 | United Kingdom | 37/117.5 |

*Primary Examiner*—Edgar S. Burr
*Assistant Examiner*—Steven A. Bratlie
*Attorney, Agent, or Firm*—Charles E. Lanchantin, Jr.

[57] ABSTRACT

A replaceable corner tooth assembly is disclosed, for an earthmoving implement having a sidewall member and a base plate member disposed in laterally extending relation therefrom at a forward corner thereof, including an elongated body with a rearwardly extending, fully corner encasing angle member and a rearwardly extending cooperating inner leg which load-transferringly and interlockingly embrace the sidewall member and the base plate member at the forwardly disposed intersection thereof for maximizing effective corner protection of the implement.

4 Claims, 4 Drawing Figures

REPLACEABLE CORNER TOOTH ASSEMBLY

BACKGROUND OF THE INVENTION

This invention relates to a replaceable corner tooth assembly for an earthmoving implement such as a loader bucket, bulldozer blade, scraper bowl and the like. Such implements typically experience the most severe wear and damage to the forwardly disposed outside corners, and to facilitate improved penetration of the earth they are frequently equipped with a plurality of replaceable forwardly extending tooth assemblies, including corner tooth assemblies, which tend to extend the service life of the corners. However, it is difficult to provide an economically integrated corner tooth assembly at the intersection of the usual sidewall and laterally extending cutting edge, and, consequently, the most conventional solution is to utilize an end bit arrangement having a forwardly extending tooth assembly thereon which is bolted onto the implement laterally inwardly of the sidewall. Unfortunately, the forces acting on the end bit arrangement are so great, as a result of prying out boulders and the like, that it is made heavier and with a relatively large number of retaining bolts at added cost and at a reduction in the serviceability thereof. Further, even though various interlocking devices are utilized to remove a substantial portion of the bolt loads, these end bit arrangements still do not provide a maximum degree of protection to the corner of the implement. These difficult-to-handle conventional end bit arrangements are represented generally by U.S. Pat. No. 2,914,868, issued Dec. 1, 1959 to E. L. Launder.

Less typically, replaceable tooth assemblies of a rearwardly extending bifurcated leg construction have been proposed for the corners of the implement as exemplified by U.S. Pat. No. 3,621,594 issued Nov. 23, 1971 to F. C. Hahn et al. and U.S. Pat. No. 3,812,608 issued May 28, 1974 to T. A. Ratkowski. However, in the referenced constructions extensive and expensive modifications are made to each sidewall and tooth assembly in order to more rigidly couple them together. This added complexity interferes with the conversion of the implement to a nonpenetrating type of operation, such as is desired with cleanup or utilitarian work. Consequently, they always operate with the tooth assemblies installed. A further disadvantage of these tooth assemblies is that their bifurcated legs do not present sufficient beam strength and sufficient material for exposure to wear at the exterior lower and side surfaces thereof. They are subsequently made larger and heavier at additional expense.

Another example of a corner tooth assembly is disclosed in U.S. Pat. No. 3,762,079 issued Oct. 2, 1973 to P. J. Lukavich et al. Besides suffering from several of the disadvantages enumerated immediately above, the referenced tooth assembly does not extend laterally outwardly beyond the exterior surface of the implement's sidewall sufficiently to maximize protection thereof.

SUMMARY AND OBJECTS OF THE INVENTION

Accordingly, it is an object of the present invention to provide an improved replaceable corner tooth assembly for an earthmoving implement which is relatively strong and durable in its construction and operation, while also assuring maximum protection to the corner of the implement.

Another object is to provide such as improved corner tooth assembly which is interlockingly mounted in a manner better able to transfer the loading forces thereon, due to penetrating the earth, directly into the corner members of the implement, and thus require only a limited number of retaining devices to positively couple it to the implement.

Another object is to provide a corner tooth assembly having the aforementioned characteristics which will further permit a relatively economical and lightweight implement corner construction to be employed.

Another object is to provide a corner tooth assembly of the aforementioned improved interlocking type which may be easily installed and which may be conveniently removed to allow the implement to be converted to utilitarian or cleanup operations.

Other objects and advantages of the present invention will become more readily apparent on reference to the accompanying drawings and the following description.

DESCRIPTION OF THE PREFERRED EMBODIMENT

Figure 1:
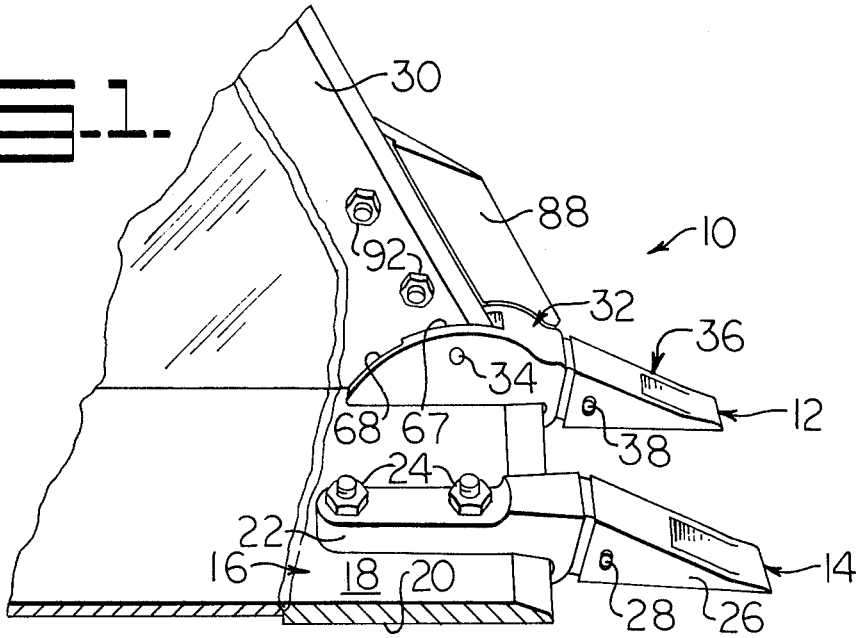
FIG. 1 is a fragmentary perspective view of the inside of the left front corner of an earthmoving implement such as a loader bucket showing the replaceable corner tooth assembly of the present invention thereon.

With reference to FIG. 1 of the drawings, a fragmentary perspective view of the left hand front corner of an earthmoving implement 10, such a loader bucket for a shovel or the like, illustrates a replaceable corner tooth assembly 12 constructed in accordance with the present invention as well as a representative one of a plurality of transversely spaced center tooth assemblies 14 of conventional construction. Each of the conventional longitudinally extending center tooth assemblies is removably mounted on a laterally extending substantially horizontal base plate member or leading cutting edge 16 in embracing relation with respect to an upper surface 18 and a lower surface 20 thereon. Further, each of the conventional center tooth assemblies includes a bifurcated tooth adapter 22, which is secured to the cutting edge by a plurality of fasteners or bolts 24, and a replaceable wear tip 26 which is removably secured thereto through a quick-change fastening device 28.

In accordance with the present invention, the replaceable corner tooth assembly 12 is mounted laterally outwardly on the loader bucket 10 in embracing protecting relation to both the cutting edge 16 and a substantially upright sidewall member 30. In general, the corner tooth assembly includes a rearwardly disposed elongated tooth adapter 32, which is removably secured to the loader bucket through a single quick-change fastening device generally indicated by the numeral 34, and a forwardly disposed replaceable wear tip 36 secured to the forward end of the adapter through a substantially similar quick-change fastening device 38. In this way the replaceable wear tip 36 is substantially laterally aligned with the plurality of wear tips 26 on the center tooth assemblies 14 to enable the loader bucket to better penetrate the earth.

It should hereinafter be appreciated that the left hand corner tooth assembly 12, shown and discussed above in connection with FIG. 1, is substantially a mirror image of the right hand front corner tooth assembly illustrated at an enlarged scale in the remaining FIGS. 2, 3 and 4 and discussed immediately below.

Figure 2:
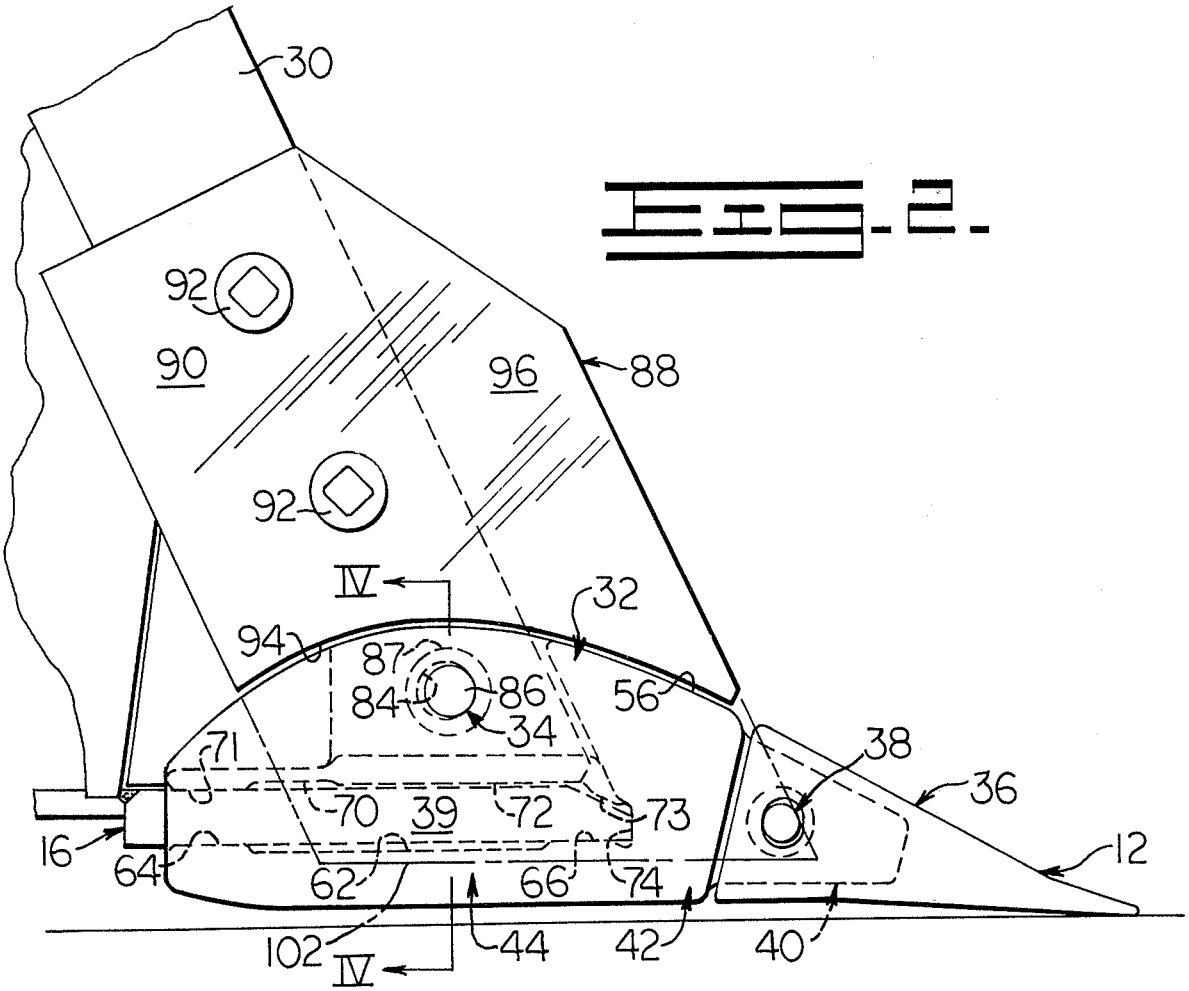
FIG. 2 is an enlarged side elevational view of the earthmoving implement of FIG. 1 showing the right front corner tooth assembly of the present invention thereon.

As best shown in FIG. 2, the adapter 32 of the right hand front corner tooth assembly 12 of the present invention has an elongated body 39 of three sections including a forwardly converging nose portion 40, a central solid body portion 42 and a longitudinally elongated and rearwardly extending rigid gripping portion 44. Upon inspection of FIG. 4, it will be seen that the gripping portion of the adapter is defined by a longitudinally extending rearwardly outwardly opening angle-shaped or L-shaped cavity 46 which opens upwardly and laterally inwardly to form a relatively strong inwardly facing L-shaped angle member 48 and an inner leg or inside wall 50 coextending substantially horizontally rearwardly therewith from the central solid body portion.

More specifically, the fully corner encasing angle member 48 of the adapter 32 includes an upright outer leg or outside wall 52 with a smooth internal wall surface 54, a convexly shaped upper surface 56, and a pin-receiving bore 58 laterally horizontally disposed therethrough. It further has a relatively thick, inwardly extending leg or base 60 having a relieved upper surface 62 with a rearwardly disposed load bearing pedestal 64 and forwardly disposed load bearing pedestal 66 as is shown in FIG. 2. In a cooperating manner the inner leg 50 of the adapter includes a stepped internal wall surface with a forwardly disposed load bearing wall 67 and a rearwardly disposed relieved wall 68 as illustrated best in FIG. 3. As shown in FIG. 2 it further includes a relieved lower surface 70 with a rearwardly disposed and depending load bearing pedestal 71 and a longitudinally elongated and centrally disposed and depending load bearing pedestal 72 at the opposite ends of the relieved lower surface, and an inclinably depending load bearing pedestal 73 at the front end thereof which are disposed in close proximity to the cutting edge 16 to better enable vertical loads to be transferred thereto. On the other hand, as the implement 10 is urged forwardly through the earth rearward horizontal loads are transferred from the adapter into the cutting edge by way of a generally abutting end wall 74 which is formed within the adapter at the forward part of the L-shaped cavity 46. As is shown in FIG. 4, the inner leg also has a bevelled lower outwardly facing surface 76 to provide clearance for a weld 78 intermediately rigidly connecting the cutting edge 16 and the sidewall 30, as well as a pin-receiving bore 80 and a counterbore 82 opening on the internal wall surface 68.

Figure 4:
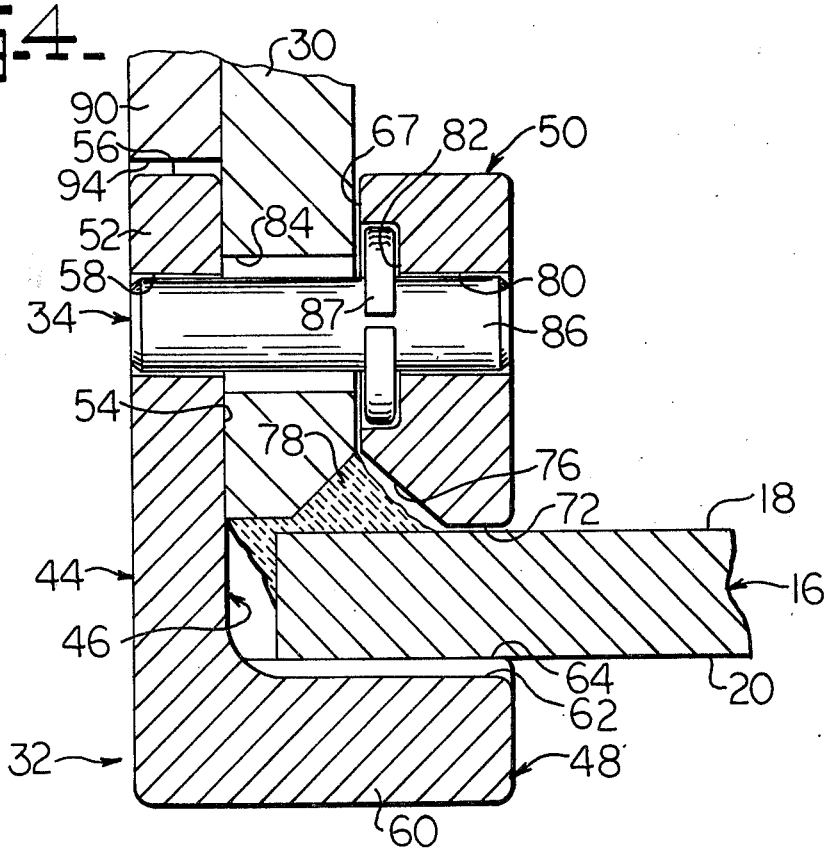
FIG. 4 is a fragmentary vertical, transverse sectional view of the right front corner tooth assembly of the present invention as taken along the line IV—IV of FIG. 2.

In order to positively retain the adapter 32 on the loader bucket 10 in the event of reverse loading thereof, the fastening device 34 is utilized as best shown in FIG. 4. As is clearly apparent, only a single, slightly enlarged bore 84 is required through the sidewall 30 for its receipt therethrough. The fastening device includes a cylindrical steel retaining pin 86 which extends spannably between and closely insertably within the axially aligned adapter bores 58 and 80, and through the sidewall bore 84 which is longitudinally offset a predetermined amount with respect to the aligned bores and otherwise provided with a relatively significant degree of radial clearance to assure the absence of forward loading of the pin and easy assembly thereof. The pin is retained in place by a resilient retaining ring or split spring ring 87 which is disposed in the counterbore 82 of the adapter and is peripherally grippingly mounted on the pin. In this way the resilient retaining ring dependably frictionally resists the lateral movement of the pin relative to the implement.

Figure 3:
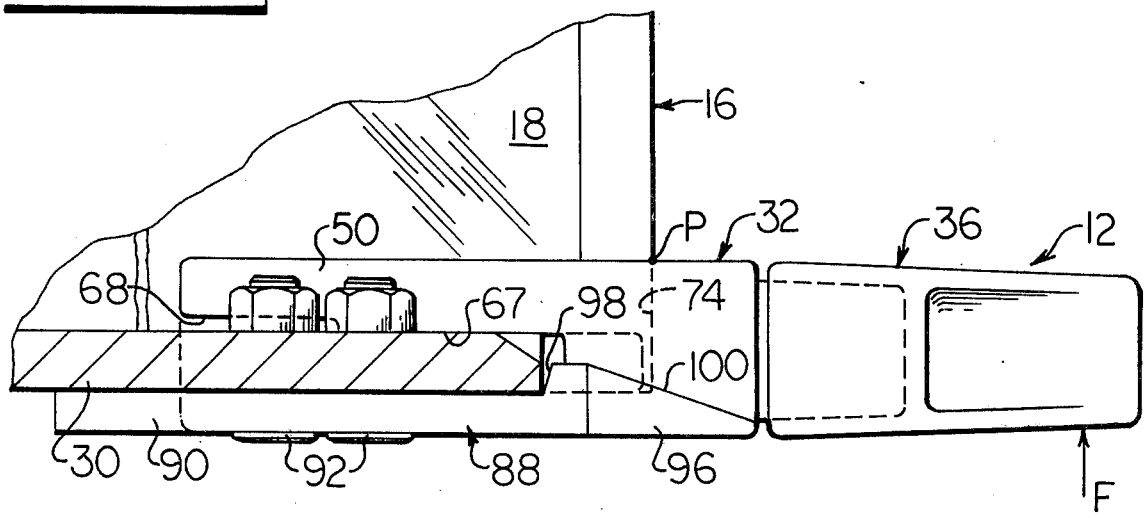
FIG. 3 is a fragmentary plan view of the earthmoving implement and replaceable corner tooth assembly of FIG. 2.

Referring now to FIGS. 2 and 3, the corner tooth assembly 12 also includes a sidecutter or router bit 88 which is mounted on the sidewall 30 of the loader bucket 10 protectingly above the adapter 32. The router bit has a planar rear portion 90 of a thickness substantially equal to the outside wall 52 of the adapter with suitable openings therethrough, not shown, for receipt of a pair of retaining bolt assemblies 92. These bolt assemblies pass connectably through the sidewall of the bucket and are aligned with the fastening device 34 of the adapter, so that a concave lower edge surface 94 on the router bit is intimately cooperatively associated with the convex upper surface 56 of the adapter. The router bit also has a forwardly disposed leading edge portion 96 of half-arrow shaped section providing an interlocking step 98 and an outwardly converging inner sidecutting surface 100 as best shown in FIG. 3.

It is contemplated that the corner tooth assemblies 12 and center tooth assemblies 14 can be removed, if desired, and a full length router bit 102 mountably secured to each sidewall 30 as illustrated by the router bit 88 and depending phantomline extension thereof in FIG. 2, in which case a third bolt assembly 92, not shown, would be utilized at the location of the opening 84 in the sidewall. This would reduce the loader buckets digging and penetrating capability, but convert it to utilitarian work, such as cleanup operations where smooth ground conditions prevail or are desired. Such extended length router bit serves to limitedly protect the forward outside corner of the bucket preparatory to reinstalling the tooth assemblies.

OPERATION

While the operation of the present invention is believed clearly apparent from the foregoing description, further amplification will subsequently be made in the following brief summary of such operation. During forward movement of the loader bucket 10 penetratingly through the earth, as may be best visualized with reference to FIG. 2, the replaceable wear tip 36 transmits loads substantially directly rearwardly upon the converging nose portion 40 of the adapter 32 with a minimum of loading of the fastening device 38. Such loads are thereafter effectively transmitted by the adapter directly to the cutting edge 16 via the abutting contact established therebetween at the end wall 74 without any loading of the fastening device 34. On the other hand, vertical loads on the nose portion are transmitted by the longitudinally spaced load bearing pedestals 64, 66, 71, 72 and 73 of the adapter efficiently directly to the cutting edge, and as may best be visualized with reference to FIGS. 3 and 4 side loads are primarily transmitted by the internal wall surfaces 54 and 67 to the closely associated sidewall 30. It should also be appreciated that a portion of the side loads are transferred to the cutting edge through the end wall 74 within the adapter. For example, as shown by the force indicating arrow identified by the letter F in FIG. 3, the adapted is urged in a counterclockwise manner about a pivot point P at the inner edge of this end wall. And, while this imposes bending loads on the inner leg 50, the bending loads are beneficially reduced because the endward relief provided by the internal wall 68 causes the load transfer between the load bearing wall 67 and the sidewall member 30 to be longitudinally closer to such pivot point.

In this way, the replaceable corner tooth assembly 12 of the present invention is disposed in load-transferring interlocking relation on the sidewall and the cutting edge 16 protectingly at the forwardly disposed intersection thereof. In this position it is beneficially entrapped in two planes, at right angles from another, by the loader bucket. In accordance with one aspect of the invention, the adapter 32 inclues the L-shaped cavity 46 within its elongated gripping portion 44, which serves to define the fully corner encasing and relatively strong angle member 48 as illustrated in FIG. 4. This angle member has a high beam strength because of its transversely deep and substantially cross sectional area and elongation in the travel direction, and provides maximum corner protection of the loader bucket 10. Specifically, note that in the particular embodiment illustrated the base 60 is relatively thick providing a substantial amount of material for wear which is extensive at its lower surface. Further, note that the relatively tall upright outer leg 52 is disposed fully laterally outwardly of the sidewall of the loader bucket for maximum protection to its side, and presenting a significantly large and continuous side surface area for exposure to wear. Thus, the L-shaped angle member resembles the wear pattern at the corner of the loader bucket, and the maximum protection provided permits a reduction in the required thickness of the sidewall and the size of the corner weld 78. This is in marked contrast to simply adopting the usual bifurcated adapter 22 shown in FIG. 1 to the corner area of the loader bucket where it would not present either sufficient beam strength or maximum material for exposure to side wear, and further would require notching and/or other interlocking modification to the sidewall.

Upon reverse loading of the corner tooth assembly 12, such as may occur in reverse dragging movement of the loader bucket 10 on the earth, the fastening device 34 becomes operationally effective to positively prevent the adapter 32 from separating forwardly away from the bucket. Further, should the adapter become significantly worn, it is a relatively simple procedure to drive the retaining pin 86 laterally outwardly from its FIG. 4 position by a hammer or the like. Under these circumstances, the split spring ring 87 would remain in the counterbore 82 and would be used again, along with the pin, for installing a new adapter. After removing the old adapter forwardly from the bucket, the new one with the accompanying spring ring would be inserted longitudinally rearwardly interlockingly upon the sidewall 30 and the cutting edge 16, and the bores 58 and 80 visually aligned through the sidewall bore 84. The pin is then driven laterally inwardly through the gripping split spring ring until it is in place.

It is to be appreciated that a new wear tip 36 would be installed on the adapter 32 in the same manner as described immediately above and by removal and installation of the fastening device 38. Naturally, it would normally be expected that several new wear tips would be installed before it would be necessary to replace the adapter.

Thus, it is apparent that the corner tooth assembly of the present invention is easily replaceable and provides maximum exterior corner surface protection of the implement enabling it to be more economically constructed at such location. Further, the corner tooth assembly includes an adapter having a rearwardly extending, fully corner encasing angle member and cooperating inner leg so that it may be intimately interlockingly mounted on the forwardly disposed intersection of the sidewall and cutting edge in such a rigid load-transferring relation that only a single fastening device is required. Still further, the strong adapter is constructed to have an extended wear life even while providing significantly improved corner protection to the implement.

While the invention has been described and shown with particular reference to a preferred embodiment, it will be apparent that variations might be possible, such as installing a conventional bolt and nut combination in place of the fastening device 34 that would fall within the scope of the present invention, which is not intended to be limited except as defined in the following claims.

What is claimed is:

1. A replaceable corner tooth assembly, for a loader bucket having a predetermined forward and rearward direction of travel and having an upright sidewall member and a leading cutting edge member disposed in laterally extending horizontal relation therefrom and defining an effectively workable corner edge, comprising;

a corner tooth adapter having an elongated body of three longitudinally arranged sections including a centrally disposed solid body portion, an integrally forwardly extending nose portion, and an integrally rearwardly extending gripping portion with a strong inwardly facing L-shaped angle member including a sidewall having a convexly shaped upper surface and a thick base for extended service life and with an inner leg of rugged upright rectangular cross section having a convexly shaped upper surface coextending deeply rearwardly therefrom which define between them a rearwardly L-shaped cavity that interlockingly closely receives the sidewall member and the leading cutting edge member protectingly at the intersection thereof whereupon said angle member embraces the outside of the corner edge and said inner leg lies in load bearing engagement substantially for its full length within the corner edge;

a replaceable wear tip removably mounted on said nose portion of said adapter; and retaining means intermediate said corner tooth adapter and the loader bucket, and intermediate said replaceable wear tip and said nose portion to permit quick release thereof for servicing purposes and to allow working operation of the bucket corner edge without said adapter and said tip.

2. An elongated tooth adapter, for use on a corner of an earthmoving implement, comprising;

a central solid body portion;

a converging nose portion integrally extending longitudinally forwardly from said body portion; and a relatively rigid gripping portion integrally extending longitudinally rearwardly from said body portion and including an elongated corner encasing L-shaped angle member having a thick base and an upright outer leg and a cooperating closely associated inner leg extending coextensively therewith to define an elongated L-shaped cavity therebetween for mounting of the adapter on the implement, and wherein said base has an upstanding rearwardly disposed load bearing pedestal and an upstanding forwardly disposed load bearing pedestal and said inner leg has a depending rearwardly disposed load bearing pedestal and a depending forwardly disposed load bearing pedestal in vertically cooperating facing relation to those on said base.

3. A replaceable corner tooth assembly for a loader bucket having a predetermined forward and rearward direction of travel and having an upright sidewall member and a leading edge member disposed in laterally extending horizontal relation therefrom; comprising;

a corner tooth adapter having an elongated body of three longitudinally arranged sections including a centrally disposed solid body portion, an integrally forwardly extending nose portion, and an integrally rearwardly extending gripping portion with an inwardly facing L-shaped angle member and an inner leg coextending deeply rearwardly therefrom which define between them a rearwardly elongated L-shaped cavity that interlockingly closely receives the sidewall member and the leading edge member protectingly at the intersection thereof and wherein said inner leg has a stepped internal wall surface with a forwardly disposed load bearing wall and a rearwardly disposed longitudinally notched wall portion partially extending inward from the rear end of the inner leg on the side nearest the sidewall for effectively reducing the bending loads on said inner leg when external working forces act on said wear tip normal to said direction of travel, and by said inner leg making contact with said sidewall member at a location at the front end and/or forward of the notched wall portion;

a replaceable wear tip removably mounted on said nose portion of said adapter; and retaining means intermediate said corner tooth adapter and the loader bucket, and intermediate said replaceable wear tip and said nose portion to permit quick release thereof for servicing purposes.

4. A replaceable corner tooth assembly for a loader bucket having a predetermined forward and rearward direction of travel and having an upright sidewall member and a leading edge member disposed in laterally extending horizontal relation therefrom, comprising;

a corner tooth adapter having an elongated body of three longitudinally arranged sections including a centrally disposed solid body portion, an integrally forwardly extending nose portion, and an integrally rearwardly extending gripping portion with an inwardly facing L-shaped angle member and an inner leg coextending deeply rearwardly therefrom which define between them a rearwardly elongated L-shaped cavity that interlockingly closely receives the sidewall member and the leading edge member protectingly at the intersection thereof and wherein said inner leg includes longitudinally spaced apart depending load bearing pedestal means and said angle member includes vertically opposite longitudinally spaced apart and cooperating upstanding load bearing pedestal means to enable vertical loads on the adapter to be better transferred to said leading edge member;

a replaceable wear tip removably mounted on said nose portion of said adapter; and retaining means intermediate said corner tooth adapter and the loader bucket, and intermediate said replaceable wear tip and said nose portion to permit quick release thereof for servicing purposes.

* * * * *